US008961256B2

(12) United States Patent
Yi

(10) Patent No.: US 8,961,256 B2
(45) Date of Patent: Feb. 24, 2015

(54) APPARATUS AND METHOD OF FABRICATING ORGANIC ELECTROLUMINESCENT DEVICE

(71) Applicant: LG Display Co., Ltd., Seoul (KR)

(72) Inventor: Kyung-Soo Yi, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 177 days.

(21) Appl. No.: 13/777,850

(22) Filed: Feb. 26, 2013

(65) Prior Publication Data

US 2013/0225028 A1 Aug. 29, 2013

(30) Foreign Application Priority Data

Feb. 29, 2012 (KR) ..... 10-2012-0021379

(51) Int. Cl.
*H01J 9/26* (2006.01)
*H05B 33/10* (2006.01)

(52) U.S. Cl.
CPC ..... *H05B 33/10* (2013.01)
USPC ..... 445/67; 445/25

(58) Field of Classification Search
CPC ... H01L 51/56; H01L 51/5237; H01L 51/003; H01L 27/3283
USPC ..... 445/23, 24, 25, 66, 67
See application file for complete search history.

(56) References Cited

U.S. PATENT DOCUMENTS

2003/0232563 A1* 12/2003 Kamiyama et al. ..... 445/24
2013/0341598 A1* 12/2013 Chang et al. ..... 257/40

* cited by examiner

*Primary Examiner* — Andrew Coughlin
(74) *Attorney, Agent, or Firm* — Birch, Stewart, Kolasch & Birch, LLP

(57) ABSTRACT

A method and apparatus for fabricating an organic electroluminescent device, are discussed. According to an embodiment, the method includes depositing an organic material on a substrate coupled to a first tray in a first substrate treatment unit using the first tray as a mask, depositing a metal material on the substrate coupled to a second tray in a second substrate treatment unit using the second tray as mask, wherein the deposition of the organic material or the metal material in the first and second substrate treatment units includes primarily moving the first and second trays such that the first and second trays are aligned with the substrate, when each of the first and second trays is coupled to the substrate, and secondarily moving the first and second trays and the substrate such that the substrate and the trays are aligned at predetermined positions.

12 Claims, 6 Drawing Sheets

APPARATUS AND METHOD OF FABRICATING ORGANIC ELECTROLUMINESCENT DEVICE

This application claims the benefit of Korean Patent Application No. 10-2012-0021379, filed on Feb. 29, 2012, which is hereby incorporated by reference as if fully set forth herein.

BACKGROUND OF THE INVENTION

1. Field of the Invention

The present invention relates to an apparatus and a method for fabricating an organic electroluminescent device to reduce a process time and simplify a structure.

2. Discussion of the Related Art

A variety of flat displays to reduce weight and volume which are drawbacks of cathode ray tubes have been developed. Examples of flat displays include liquid crystal displays, field emission displays, plasma display panels, organic electroluminescence (EL) devices and the like.

In particular, organic electroluminescent devices voluntarily emit light and have advantages of high response speed, superior luminous efficacy, excellent brightness and high viewing angle, as compared to other flat displays. These conventional organic electroluminescent devices include an organic film or a metal film including at least one of red, green and blue light-emitting layers formed on a substrate through a cluster manner in which a plurality of deposition chambers are connected to one transport chamber, thus increasing a standby time of the substrate and lengthening a process time.

In addition, since use of a metal mask is required for formation of conventional organic and metal films, disadvantageously, a transport robot to transport the metal mask is required and an apparatus for cleaning and inspecting the metal mask is further required.

SUMMARY OF THE INVENTION

Accordingly, the present invention is directed to an apparatus and a method for fabricating an organic electroluminescent device that substantially obviate one or more problems due to limitations and disadvantages of the related art.

An object of the present invention is to provide an apparatus and a method for fabricating an organic electroluminescent device to reduce a process time and simplify a structure.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for fabricating an organic electroluminescent device includes: a first substrate treatment unit for depositing an organic material on a substrate coupled to a first tray using the first tray as a mask; a first tray treatment unit disposed in a line different from that of the first substrate treatment unit, the first tray treatment unit cleaning and inspecting the first tray separated from the organic material-deposited substrate; a second substrate treatment unit disposed in one line with the first substrate treatment unit, the second substrate treatment unit depositing a metal material on the organic material-deposited substrate coupled to a second tray using the second tray as a mask; a second tray treatment unit disposed in a line different from that of the second substrate treatment unit, the second tray treatment unit cleaning and inspecting the second tray separated from the metal material-deposited substrate; and a sealing unit disposed in one line with the second substrate treatment unit, the sealing unit sealing the metal material-deposited substrate, wherein each of the first and second substrate treatment units includes: a movement control unit for primarily moving the first and second trays such that the first and second trays are aligned with the substrate, when the first and second trays are coupled to the substrate, and for secondarily moving each of the first and second trays, and the substrate such that the substrate and the trays are aligned at predetermined positions.

The substrate may linearly move along the first substrate treatment unit, the second substrate treatment unit and the sealing unit arranged in one line, wherein the first tray circulates along the first substrate treatment unit and the first tray treatment unit, and the second tray circulates along the second substrate treatment unit and the second tray treatment unit.

Each of the first and second substrate treatment units may include: a coupling unit for coupling each of the first and second trays to the substrate; a deposition unit for forming a thin film on the substrate coupled to each of the first and second trays; and a separation unit for separating each of the first and second trays and the thin film-provided substrate.

The coupling unit may include: the movement control unit; a base plate moving along the movement control unit; and a lift pin formed on the base plate, the lift pin fixing each of the first and second trays and the substrate, wherein the deposition unit includes a deposition source disposed under the substrate coupled to each of the first and second trays.

The apparatus may further include: a pre-treatment unit loaded such that a lower surface of the substrate faces the ground, before the first tray is coupled to the substrate, the pre-treatment unit removing impurities present on a upper surface of the substrate; and a reversion unit disposed between the pre-treatment unit and the coupling unit of the first substrate treatment unit, the reversion unit reversing the substrate such that the upper surface of the substrate faces the ground.

Each of the first and second tray treatment units may include: a cleaning unit for cleaning each of the first and second trays separated from the substrate; an inspection unit for inspecting the cleaned first and second trays; and a stoker for storing and transporting each of the first and second trays which are cleaned or separated from the substrate.

In another aspect of the present invention, a method for fabricating an organic electroluminescent device includes: depositing an organic material on a substrate coupled to a first tray in a first substrate treatment unit using the first tray as a mask; cleaning and inspecting the first tray separated from the substrate, on which the organic material is deposited, in a first tray treatment unit disposed in a line different from that of the first substrate treatment unit, while the organic material is deposited; depositing a metal material on the substrate coupled to a second tray in a second substrate treatment unit using the second tray as mask; cleaning and inspecting the second tray separated from the substrate, on which a metal material is deposited, in a second tray treatment unit disposed in a line different from that of the second substrate treatment unit, while the metal material is deposited; and sealing the metal material-deposited substrate in a sealing unit arranged in one line with the second substrate treatment unit, wherein the deposition of the organic material or the metal material in the first and second substrate treatment units includes: primarily moving the first and second trays such that the first and second trays are aligned with the substrate, when each of the first and second trays is coupled to the substrate; and secondarily moving the first and second trays and the substrate such that the substrate and the trays are aligned at predetermined positions.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
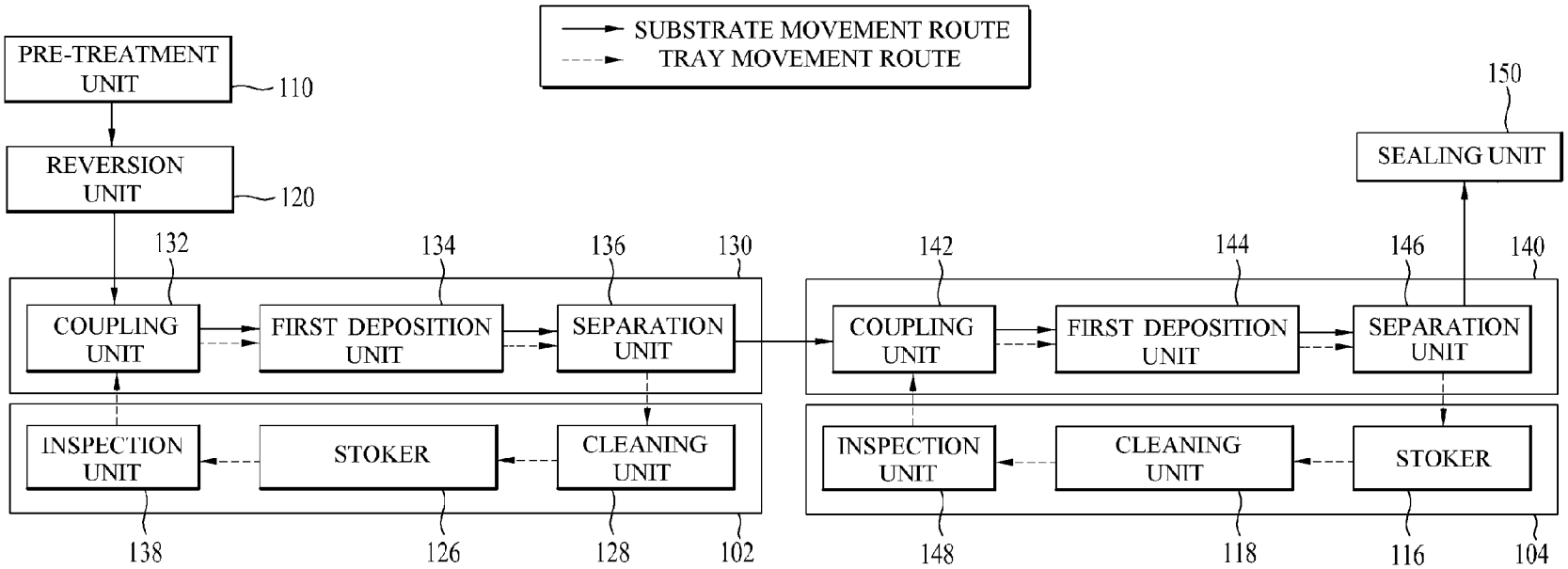
FIG. 1 is a plan view illustrating an apparatus for fabricating an organic electroluminescent device according to the present invention.

FIG. 1 is a schematic diagram illustrating an apparatus for fabricating an organic electroluminescent device according to the present invention.

The apparatus for fabricating an organic electroluminescent device shown in FIG. 1 includes a pre-treatment unit 110, a reversion unit 120, first and second substrate treatment units 130 and 140, and a sealing unit 150 which are arranged in an in-line manner.

After a substrate provided with a first electrode is load, the pre-treatment unit 110 performs pre-treatment to remove impurities having a negative effect on an organic electroluminescent device, before an organic material is deposited on the first electrode. Specifically, when the first electrode-provided substrate is loaded in a face-up state in which a lower surface 170*b* of the substrate faces the ground, the face-up state of substrate provided with the first electrode is cleaned, cured, baked, cooled and treated with plasma.

The reversion unit 120 rotates the face-up substrate an angle of 180 degrees, to reverse the face-up substrate into a face-down state.

The first substrate treatment unit 130 forms an organic film through a deposition process on the face-down substrate in which the upper surface of the substrate faces the ground. For this purpose, the first substrate treatment unit 130 includes a coupling unit 132, a first deposition unit 134 and a separation unit 136 which are arranged in an in-line manner between the reversion unit 120 and the second substrate treatment unit 140.

The second substrate treatment unit 140 forms a metal film on the organic film-provided face-down substrate through a deposition process. For this purpose, the second substrate treatment unit 140 includes a coupling unit 142, a metal deposition unit 144 and a separation unit 146 which are arranged in an in-line manner between the first substrate treatment unit 130 and the sealing unit 150.

Figure 2:
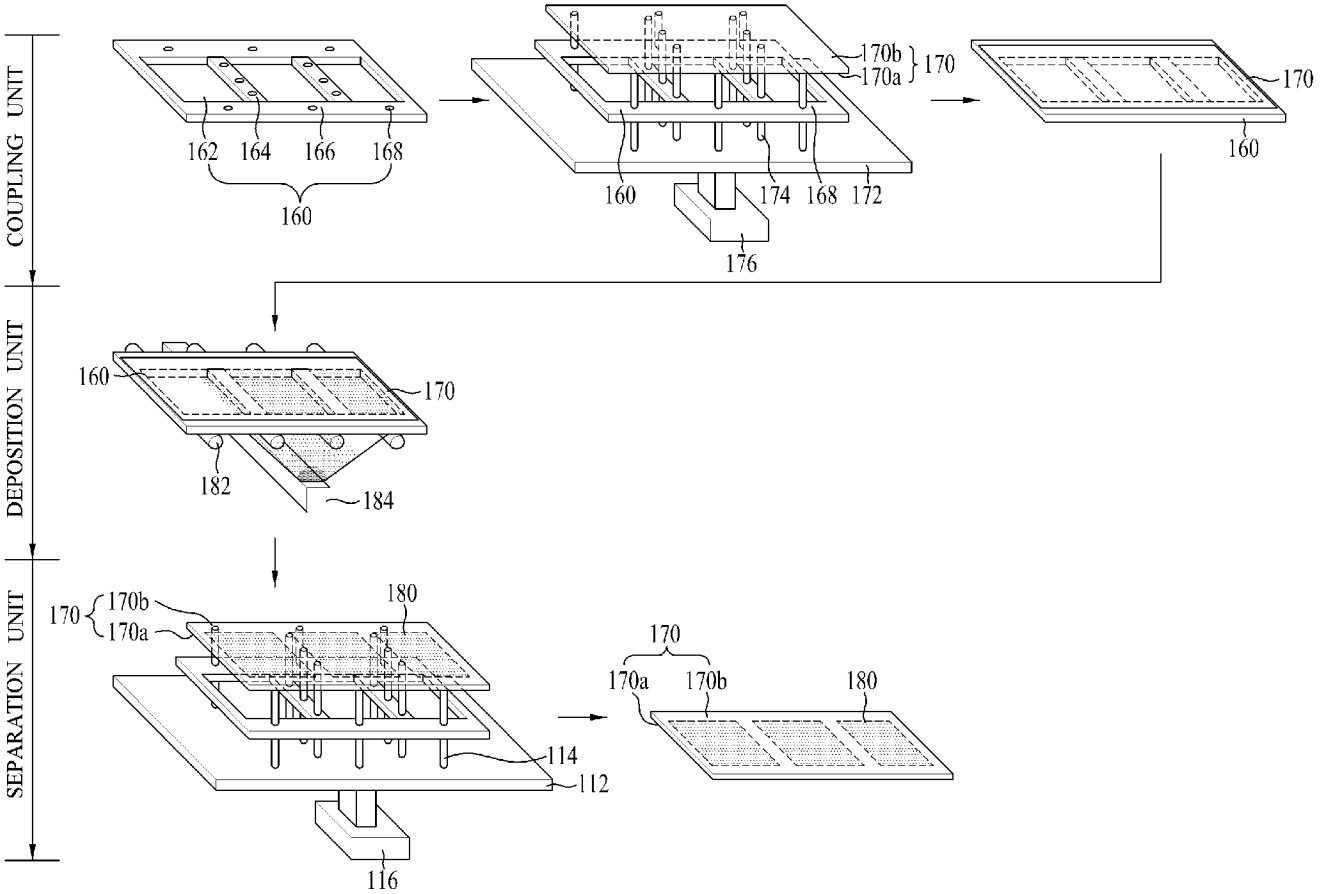
FIG. 2 is a perspective view illustrating a coupling unit, a deposition unit and a separation unit shown in FIG. 1.

As shown in FIG. 2, in the respective coupling units 132 and 142 of the first and second substrate treatment units 130 and 140, the tray 160 and the substrate 170 which are cleaned and inspected in the first and second tray treatment units 102 and 104 are coupled to each other. Here, the tray 160 includes a square frame 166 that supports the substrate 170, a division pattern 164 to divide the square frame 166 to have an opening corresponding to a unit light-emitting panel region of the substrate 170, and a lift pin hole 168 formed in at least one of the square frame 166 and the division pattern 164. The number of the division patterns may be changed depending on the size of the unit light-emitting panel region. That is, when a plurality of small unit light-emitting panels are formed on the substrate 170, the number of the necessary division patterns 164 is one smaller than the number of the unit light-emitting panel regions formed on the substrate 170. In addition, when one large unit light-emitting panel is formed on the substrate 170, the division pattern 164 is unnecessary.

A process of coupling the tray 160 to the substrate 170 in the coupling units 132 and 142 will be described with reference to FIGS. 2 to 3C.

Figure 3A:
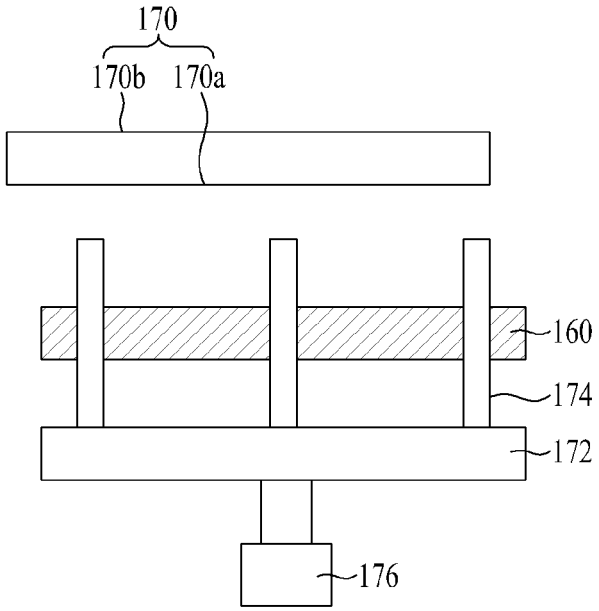
FIGS. 3A to 3C are sectional views illustrating a process for aligning a substrate and a tray shown in FIG. 2.

As shown in FIG. 3A, when a tray 160 is loaded on a base plate 172 in the coupling units 132 and 142, the lift pin 174 formed on the base plate 172 lifts up and passes through a lift pin hole 168 formed on the tray 160. Accordingly, the tray 160 is aligned at a predetermined position of the base plate 172.

Figure 3B:
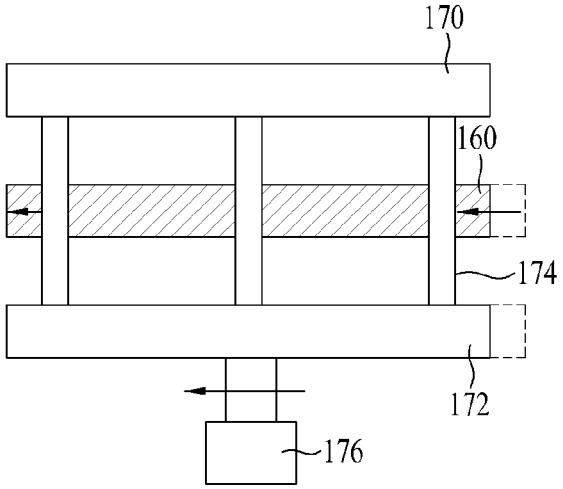

Then, when the substrate 170, the upper surface 170*a* of which faces the ground, is loaded in the coupling units 132 and 142, as shown in FIG. 3B, the tray 160 loaded on the base plate 172 is moved through a movement control unit 176 such that it is aligned with an alignment mark of the substrate 170, while the substrate 170 is set, and as a result, the substrate 170 and the tray 160 are primarily aligned. At this time, the tray 160 checks the position of the substrate 170 with respect to the alignment mark through a vision unit (not shown) including a camera, a laser or the like and is then arranged together with the substrate 170. Meanwhile, after the substrate 170 is loaded on the tray 160, the substrate 170 independently cannot move from side to side and alignmemt of the substrate 170 and the tray 160 is impossible. Accordingly, before the substrate 170 is loaded on the tray 160, an alignment process between the substrate 170 and the tray 160 is performed by independently moving the tray 160, while the substrate 170 is set.

Figure 3C:
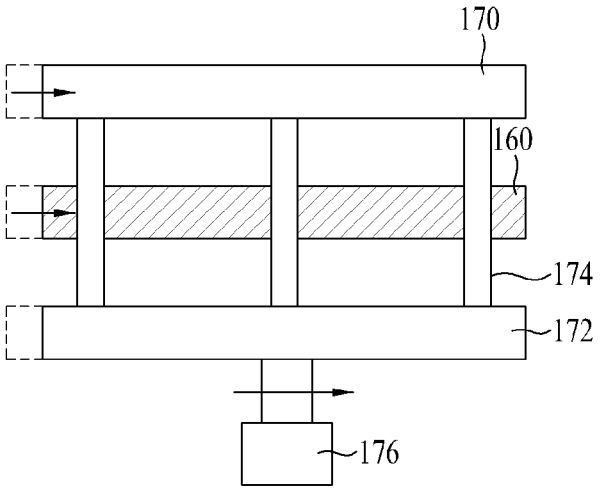

Then, the substrate 170 and tray 160 which are primarily aligned move together through the movement control unit 176 and are then secondarily aligned at predetermined positions in the coupling units 132 and 142 which are the original positions of the tray 160, as shown in FIG. 3C.

Then, as shown in FIG. 2, when the lift pin 174 provided between the substrate 170 and tray 160 which are secondarily aligned lifts down, the substrate 170 is accurately aligned and coupled on the tray 160 and is transported into the corresponding deposition units 134 and 144. Meanwhile, in order to improve a fixing force between the tray 160 and the substrate 170, after the substrate 170 is fixed on the tray 160 through a clamp (not shown) formed on the square frame of the tray 160, it may be transported to the corresponding deposition units 134 and 144.

The first deposition unit 134 deposits an organic material vapor generated in an evaporation source 184 disposed under the tray 160 on the substrate 170 coupled to the tray 160 in the coupling unit 132 to form a thin film 180 on the upper substrate 170*a* of the substrate 170. The thin film 180 formed in the first deposition unit 142 is used as an organic film that realizes at least one of red, green, blue and white. Here, the evaporation source 184 may comprise a plurality of evaporation sources 184 containing different organic materials. Accordingly, the organic film formed on the substrate may comprise an organic film including a plurality of layers.

The second deposition unit 144 deposits a metal material vapor generated in the evaporation source 184 disposed under the tray 160 on the substrate 170 coupled to the tray 160 in the coupling unit 142, to form a thin film 180 on the upper surface 170*a* of the substrate. The thin film 180 formed in the second deposition unit 144 is used as a second electrode formed on the organic film that realizes at least one of red, green, blue and white. Here, the second deposition unit 144 forms the metal film on the substrate 170 through thermal deposition, thus preventing damage to the organic film which is caused by a conventional deposition method using sputtering or the like.

Figure 4:
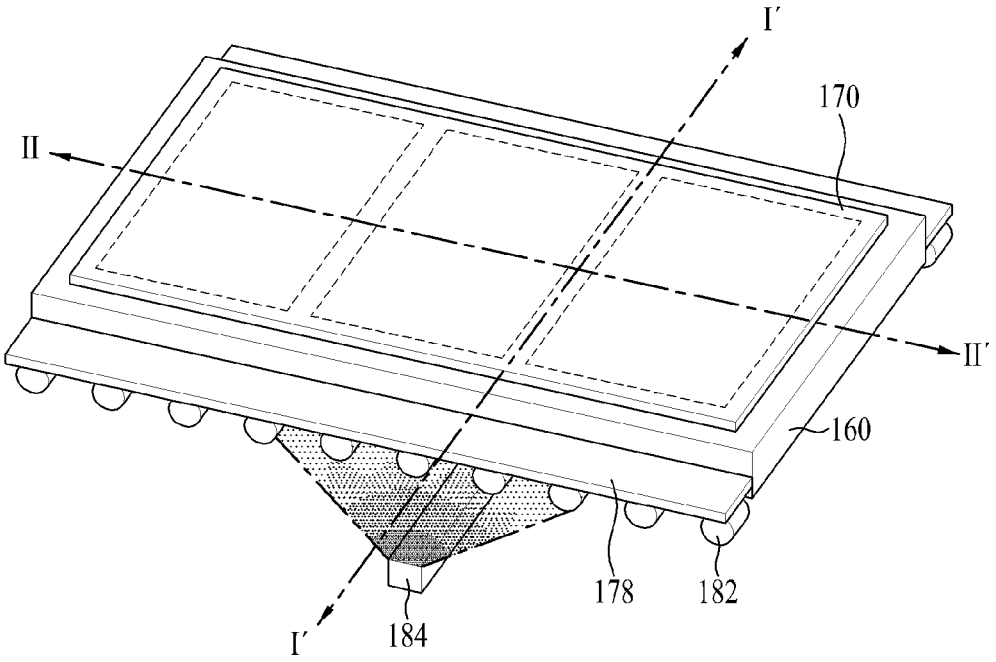
FIG. 4 is a perspective view illustrating the deposition unit shown in FIG. 2 in detail.
Figure 5A:
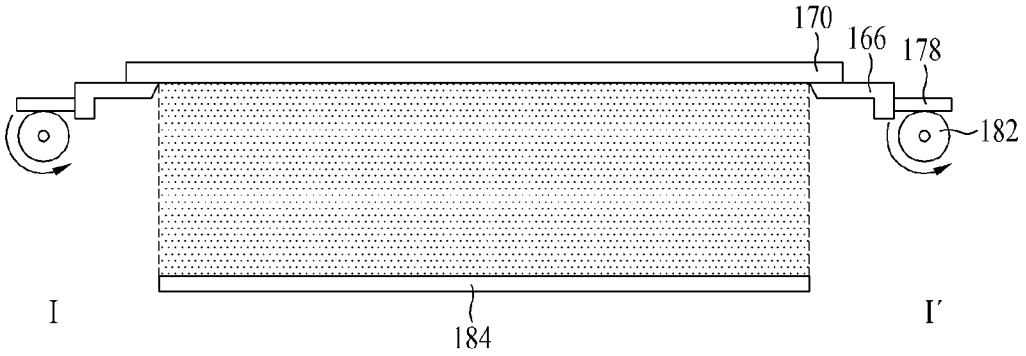
FIGS. 5A and 5B are sectional views taken along the lines "I-I'" and "II-II'" of the deposition unit shown in FIG. 4.
Figure 5B:
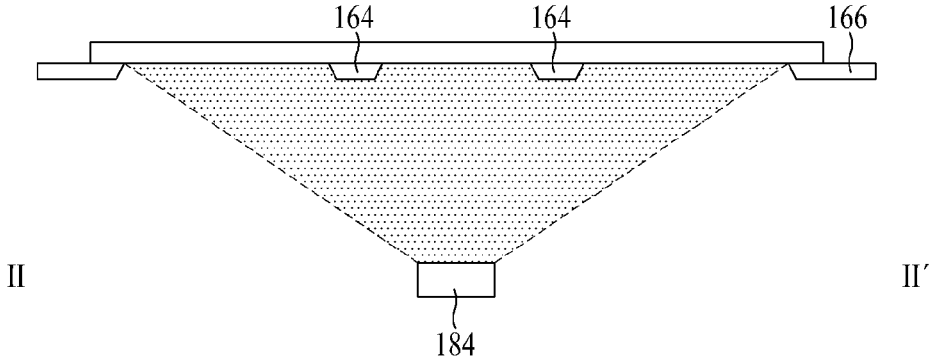

In order to form thin films in these first and second deposition units 134 and 144, as shown in FIGS. 4 and 5A, a blade 178 is formed along a long axis of the tray 160 coupled to the substrate 170. The tray 160 coupled to the substrate 170 moves on the evaporation source 184 formed among a short axis of the tray 160 from one side to the other side through the transport roller 182 disposed under the blade 178, as shown in FIG. 5B. At this time, since the transport roller 182 rotates while contacting only the blade of the tray 160, only the blade 178 need be replaced, when the blade 178 is damaged. Accordingly, an organic material or a metal material vapor generated in the evaporation source 184 is deposited on the substrate 170 to form an organic film or a metal film on the substrate 170. At this time, the tray 160 functions as a mask, thus causing selective formation of an organic film or a metal film in only the unit light-emitting panel region of the substrate 170. Here, the organic film formed on the substrate 170 and the metal film formed on the organic film have different areas and an area of the opening of the first tray 160 used in the first deposition unit 134 is thus different from an area of the opening 162 of the second tray 160 used in the second deposition unit 144. For example, the area of the metal film formed in the second deposition unit 144 may be greater than that of the organic film formed in the first deposition unit 134.

As such, the present invention performs a deposition process using the tray 160 as a mask without using a separate metal mask. Accordingly, the present invention requires neither a transport robot for transporting conventional metal masks nor additional apparatuses for cleaning and inspecting the metal mask, thus reducing cost and process time.

The separation units 136 and 146 separate the substrate 170 in which the organic film or metal film is formed in the corresponding deposition units 134 and 144 from the tray 160. Specifically, as shown in FIG. 2, when the substrate 170 coupled to the tray 160 is loaded on the base plate 112 in the separation units 136 and 146, the lift pin 114 provided on the base plate 112 lifts up, the substrate 170 and the tray 160 are separated from each other. Then, the substrate 170 separated in the separation unit 136 of the first substrate treatment unit 130 is transported to the second substrate treatment unit 140, and the tray 160 separated in the separation unit 136 of the first substrate treatment unit 130 is transported to the first tray treatment unit 102. In addition, the substrate 170 separated from the separation unit 146 of the second substrate treatment unit 140 is transported to the sealing unit 150 and the tray 160 separated in the separation unit 146 of the second substrate treatment unit 140 is transported to the second tray treatment unit 104.

Meanwhile, an acceleration chamber for arraying the tray 160 coupled to the substrate 170 at a predetermined distance while taking consideration into a deposition speed of an organic material or a metal material may be disposed between the coupling units 132 and 142 and the deposition units 134 and 144, and a deceleration chamber for arraying the tray 160 coupled to the substrate 170 at a predetermined distance while taking into consideration a separation speed between the tray 160 and the substrate 170, and a buffer chamber for accumulating the substrate when problems associated with the deposition units 134 and 144 occur may be disposed between the deposition units 134 and 144, and the separation units 136 and 146.

The first tray treatment unit 102 is arranged in a line different from that of the first substrate treatment unit 130 in an in-line manner and the second tray treatment unit 104 is arranged in a line different from that of the second substrate treatment unit 140 in an in-line manner.

Each of the first and second tray treatment units 102 and 104 includes cleaning units 118 and 128, stokers 116 and 126, and inspection units 138 and 148 arranged in an in-line manner.

The cleaning units 118 and 128 clean the tray 160 separated from the substrate 170 in the separation units 136 and 146 to remove residues left on the tray 160.

The inspection units 138 and 148 inspect the cleaned tray 160 to check presence of organic residues and surface damage, dimensions and the like.

The stokers 116 and 126 store the plurality of cleaned trays 160 through a rack master (not shown) and transport the stored trays 160 to the inspection units 138 and 148 through the rack master. At this time, positions of the stokers 116 and 126, and the cleaning units 118 and 128 may be changed. For example, the tray 160 separated from the substrate 170 in the separation units 136 and 146 is stored in the stokers 116 and 126 and is then cleaned.

Otherwise, the stokers 116 and 126 are disposed between the deposition units 134 and 144, the cleaning units 118 and 128, and the inspection units 138 and 148, the plurality of trays 160 transported from the deposition unit are stored through the rack master, the stored trays 160 are transported to the cleaning units 118 and 128 through the rack master, and the cleaned trays 160 are transported to the inspection units 138 and 148 through the rack master.

The sealing unit 150 adheres a sealing cap or sealing substrate onto the substrate 170 provided with a metal film or forms a multi-layer sealing film thereon.

As such, the present invention includes a pre-treatment unit 110, a reversion unit 120, a first substrate treatment unit 130 (a coupling unit 132, a first deposition unit 134, a separation unit 136), a second substrate treatment unit 140 (a coupling unit 142, a second deposition unit 144, a separation unit 146) and a sealing unit 150 which are arranged in an in-line manner and the substrate 170 linearly moves along these components 110, 120, 130, 140 and 150. In addition, the first tray treatment unit 102 and the first substrate treatment unit 130 are arranged in different lines in an in-line manner and the first tray thus circulates along the first substrate treatment unit 130 and the first tray treatment unit 102, while the second tray treatment unit 104 and the second substrate treatment unit 140 are arranged in different lines in an in-line manner and the second tray thus circulates along the second substrate treatment unit 140 and the second tray treatment unit 104.

As a result, the present invention can reduce a stand-by time of the substrate 170 and thus reduce the overall process time, since the substrate 170 linearly moves. In addition, the present invention uses the tray 160 as a mask, thus eliminating the necessity of a conventional metal mask, a transport robot to transport the metal mask, and additional apparatuses for cleaning and inspecting the metal mask, and reducing a process time. The present invention can secure stability of the organic electroluminescent device since the pre-treatment unit 110 performs pre-treatment to remove impurities having negative effects on the organic electroluminescent device.

Figure 6:
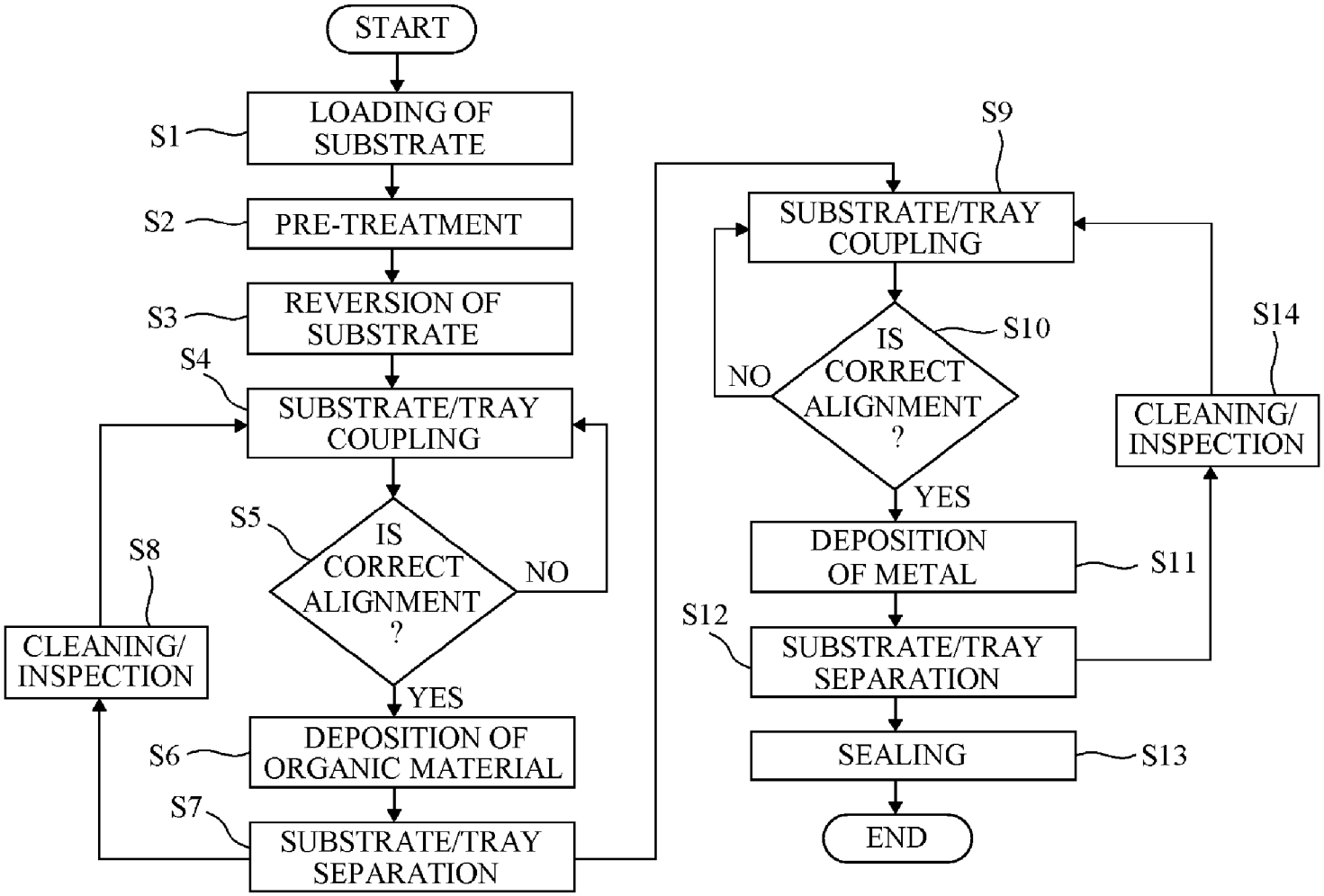
FIG. 6 is a flowchart illustrating a method for fabricating an organic electroluminescent device according to the present invention.

FIG. 6 is a flowchart illustrating a method for fabricating an organic electroluminescent device according to the present invention.

First, after a substrate 170 is loaded in a pre-treatment unit 110 in a face-up state in which a lower surface 170*b* of the substrate 170 faces the ground (S1), the face-up substrate 170 is cleaned, cured, baked, cooled and pre-treated with plasma (S2).

The pre-treated face-up substrate 170 is reversed into a face-down state such that an upper surface 170*a* of the substrate 170 faces the ground (S3).

The substrate 170 reversed into a face-down state is coupled to the cleaned and inspected tray 160 (S4). When the tray 160 and the substrate 170 coupled to each other are accurately aligned within an allowable error (S5), an organic material vapor generated in the evaporation source 184 disposed under the tray 160 is deposited on the substrate 170 and a thin film 180 is formed as an organic film on the upper surface 170*a* of the substrate (S6).

The organic thin film-provided substrate 170 and the tray 160 are separated (S7), and the tray 160 is cleaned and inspected while an organic material vapor is deposited on another substrate 170 loaded in the first substrate treatment unit 130 (S8) and is then coupled to the subsequently loaded substrate 170 (S4).

Then, the organic thin film-provided substrate 170 is coupled to the cleaned and inspected tray 160 (S9). When the tray 160 and the substrate 170 coupled to each other are accurately aligned within an allowable error (S10), a metal material vapor generated in the evaporation source 184 disposed under the tray 160 is deposited on the substrate 170 and a thin film 180 is formed as a metal film on the upper surface 170*a* of the substrate 170 (S11).

The metal thin film-provided substrate 170 and the tray 160 are separated (S12), and the tray 160 is cleaned and inspected while an organic material vapor is deposited on another substrate 170 loaded in the first substrate treatment unit 130 (S14), and is then coupled to the subsequently loaded substrate 170 (S9).

Then, a sealing cap or a sealing substrate is adhered to the metal thin film-provided substrate 170 or a multi-layer sealing film is formed thereon (S13).

As apparent from the fore-going, the present invention provides an organic electroluminescent device which includes a pre-treatment unit, a reversion unit, a first substrate treatment unit and a second substrate treatment unit which are arranged in an in-line manner, thus enabling linear movement of the substrate along these components. As a result, the standby time of the substrate can be reduced and a process time can thus be reduced. In addition, the present invention uses the tray as a mask, thus eliminating the necessity of a metal mask for forming at least one of: a conventional organic film emitting red, green and blue light; an organic layer emitting white light; and an electrode, a transport robot for transporting the metal mask and additional apparatus for cleaning and inspecting the metal mask, and reducing cost and overall process time. In addition, the present invention can secure stability of the organic electroluminescent device, since the pre-treatment unit 110 performs pre-treatment to remove impurities having negative effects on the organic electroluminescent device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for fabricating an organic electroluminescent device, the apparatus comprising:

a first substrate treatment unit for depositing an organic material on a substrate coupled to a first tray using the first tray as a mask;

a first tray treatment unit disposed in a line different from that of the first substrate treatment unit, the first tray treatment unit cleaning and inspecting the first tray separated from the organic material-deposited substrate;

a second substrate treatment unit disposed in one line with the first substrate treatment unit, the second substrate treatment unit depositing a metal material on the organic material-deposited substrate coupled to a second tray using the second tray as a mask;

a second tray treatment unit disposed in a line different from that of the second substrate treatment unit, the second tray treatment unit cleaning and inspecting the second tray separated from the metal material-deposited substrate; and a sealing unit disposed in one line with the second substrate treatment unit, the sealing unit sealing the metal material-deposited substrate, wherein each of the first and second substrate treatment units comprises:

a movement control unit for primarily moving the first and second trays such that the first and second trays are aligned with the substrate, when the first and second trays are coupled to the substrate, and for secondarily moving each of the first and second trays, and the substrate such that the substrate and the trays are aligned at predetermined positions.

2. The apparatus according to claim 1, wherein the substrate linearly moves along the first substrate treatment unit, the second substrate treatment unit and the sealing unit arranged in one line, and wherein the first tray circulates along the first substrate treatment unit and the first tray treatment unit, and the second tray circulates along the second substrate treatment unit and the second tray treatment unit.

3. The apparatus according to claim 1, wherein each of the first and second substrate treatment units comprises:

a coupling unit for coupling each of the first and second trays to the substrate;

a deposition unit for forming a thin film on the substrate coupled to each of the first and second trays; and a separation unit for separating each of the first and second trays and the thin film-provided substrate.

4. The apparatus according to claim 3, wherein the coupling unit comprises:

the movement control unit;

a base plate moving along the movement control unit; and a lift pin formed on the base plate, the lift pin fixing each of the first and second trays and the substrate, wherein the deposition unit comprises a deposition source disposed under the substrate coupled to each of the first and second trays.

5. The apparatus according to claim 3, further comprising:

a pre-treatment unit loaded such that a lower surface of the substrate faces the ground, before the first tray is coupled to the substrate, the pre-treatment unit removing impurities present on a upper surface of the substrate; and a reversion unit disposed between the pre-treatment unit and the coupling unit of the first substrate treatment unit, the reversion unit reversing the substrate such that the upper surface of the substrate faces the ground.

6. The apparatus according to claim 1, wherein each of the first and second tray treatment units comprises:

a cleaning unit for cleaning each of the first and second trays separated from the substrate;

an inspection unit for inspecting the cleaned first and second trays; and a stoker for storing and transporting each of the first and second trays which are cleaned or separated from the substrate.

7. A method for fabricating an organic electroluminescent device, the method comprising:

depositing an organic material on a substrate coupled to a first tray in a first substrate treatment unit using the first tray as a mask;

cleaning and inspecting the first tray separated from the substrate, on which the organic material is deposited, in a first tray treatment unit disposed in a line different from that of the first substrate treatment unit, while the organic material is deposited;

depositing a metal material on the substrate coupled to a second tray in a second substrate treatment unit using the second tray as mask;

cleaning and inspecting the second tray separated from the substrate, on which a metal material is deposited, in a second tray treatment unit disposed in a line different from that of the second substrate treatment unit, while the metal material is deposited; and sealing the metal material-deposited substrate in a sealing unit arranged in one line with the second substrate treatment unit, wherein the deposition of the organic material or the metal material in the first and second substrate treatment units comprises:

primarily moving the first and second trays such that the first and second trays are aligned with the substrate, when each of the first and second trays is coupled to the substrate; and secondarily moving the first and second trays and the substrate such that the substrate and the trays are aligned at predetermined positions.

8. The method according to claim 7, wherein the substrate linearly moves along the first substrate treatment unit, the second substrate treatment unit and the sealing unit arranged in one line, and the first tray circulates along the first substrate treatment unit and the first tray treatment unit, and the second tray circulates along the second substrate treatment unit and the second tray treatment unit.

9. The method according to claim 8, wherein the deposition of the organic material on the first substrate treatment unit comprises:

coupling the first tray to the substrate;

forming an organic material on the substrate coupled to the first tray; and separating the first tray and the organic material-formed substrate, and wherein the deposition of the metal material on the second substrate treatment unit comprises:

coupling the second tray to the substrate;

forming the metal material on the second tray-coupled substrate; and separating the second tray from the metal material-formed substrate.

10. The method according to claim 9, wherein the coupling one of the first and second trays to the substrate comprises:

loading one of the first and second trays on a base plate;

lifting up a lift pin present on the base plate to fix the tray;

moving the tray toward the substrate under control of the movement control unit disposed under the base plate while the substrate is fixed; and simultaneously moving each of the first and second trays and the substrate under control of the movement control unit such that the substrate and the tray are aligned at predetermined positions.

11. The method according to claim 9, further comprising:

loading the substrate in a pre-treatment unit such that a lower surface of the substrate faces the ground, before the first tray is coupled to the substrate; and reversing the substrate in a reversion unit disposed between the pre-treatment unit and the first substrate treatment unit, such that a upper surface of the substrate faces the ground.

12. The method according to claim 8, wherein the cleaning and inspecting each of the first and second trays comprises:

cleaning each of the first and second trays separated from the substrate;

inspecting the cleaned first and second trays; and storing and transporting each of the first and second trays which are cleaned or separated from the substrate.

* * * * *